US005929558A

United States Patent [19]

Lee

[11] Patent Number: 5,929,558

[45] Date of Patent: Jul. 27, 1999

[54] SHADOW MASK ASSEMBLY WITH THERMAL EXPANSION COMPENSATION

[75] Inventor: Sun-heang Lee, Suwon, Rep. of Korea

[73] Assignee: Samsung Display Devices Co., Ltd., Kyungki-Do, Rep. of Korea

[21] Appl. No.: 08/998,990

[22] Filed: Dec. 29, 1997

[30] Foreign Application Priority Data

| | | | |
|---|---|---|---|
| Dec. 30, 1996 | [KR] | Rep. of Korea | 96-76978 |
| Dec. 31, 1996 | [KR] | Rep. of Korea | 96-80179 |
| Dec. 31, 1996 | [KR] | Rep. of Korea | 96-80181 |

[51] Int. Cl.[6] ..... H01J 29/07

[52] U.S. Cl. ..... 313/402; 313/407; 313/408

[58] Field of Search ..... 313/402, 404, 313/407, 408, 403

[56] References Cited

U.S. PATENT DOCUMENTS

| | | | |
|---|---|---|---|
| 3,737,703 | 6/1973 | Tsuneta et al. | 313/85 S |
| 3,890,526 | 6/1975 | Palac | 313/408 |
| 3,904,914 | 9/1975 | Palac | 313/482 |
| 3,986,072 | 10/1976 | Adamski | 313/404 |
| 4,056,755 | 11/1977 | Sohn | 313/402 |
| 4,164,682 | 8/1979 | Palac | 313/404 |
| 4,472,657 | 9/1984 | Sakurai et al. | 313/402 |
| 4,551,651 | 11/1985 | Van Der Ven | 313/402 |
| 5,057,737 | 10/1991 | Hotta | 313/407 |
| 5,416,378 | 5/1995 | Andrevski | 313/402 |

*Primary Examiner*—Vip Patel
*Assistant Examiner*—Matthew J Gerike
*Attorney, Agent, or Firm*—Leydig, Voit & Mayer, Ltd.

[57] ABSTRACT

There is provided a shadow mask assembly for a color cathode ray tube (CRT), including a mask plate through which a multitude of electron beam passing holes are formed, a rim portion which extends from the edges of the mask plate and has a smaller radius of curvature than the radius of curvature of the mask plate, a skirt portion which extends perpendicularly from at least one of the longer and shorter edges of the rim portion, and a frame which is combined with the skirt portion and supports the skirt portion.

12 Claims, 4 Drawing Sheets

SHADOW MASK ASSEMBLY WITH THERMAL EXPANSION COMPENSATION

BACKGROUND OF THE INVENTION

1. Field of the Invention

The present invention relates to a color cathode ray tube (CRT), and more particularly, to a shadow mask assembly of a color CRT through which electron beams emitted from an electron gun are passed.

2. Description of Related Art

In a color CRT, a shadow mask is separated at a predetermined distance from and opposite a fluorescent film, and an electron beam emitted from an electron gun passes passing an electron beam passing hole formed in the shadow mask and then collides with the fluorescent film. Accordingly, the shadow mask passes electron beams according to R, G and B, thus performing a color selection function.

As shown in FIG. 1, a shadow mask assembly is comprised of a shadow mask 21 and a frame 22 for supporting the shadow mask 21. The shadow mask 21 includes a mask plate 21*a* having a plurality of electron beam passing holes 10 formed therein, a rim portion 21*b* which surrounds the mask plate 21*a,* and a skirt portion 21*c* which extends perpendicularly downward from the rim portion 21*b.* Also, the frame 22 includes a support wall 22*a* welded with the skirt portion 21*c* of the shadow mask 21, and a flange portion 22*b* extending from the support wall 22*a* inward.

During operation of the CRT, only about 15 to 30% of the electrons, i.e., electron beams emitted from an electron gun (not shown), passes passing the electron beam through holes 10 of the shadow mask 21, while most collide with the mask plate 21*a.* Accordingly, the shadow mask 21 and the frame 22 are heated by collisions with the electrons, and thus expand thermally. Here, the radius of curvature of the mask plate 21*a* varies due to a difference in thermal expansion between the shadow mask 21 and the frame 22 according to time. That is, during the initial stages of operation of the CRT, the shadow mask 21 is heated prior to the frame 22 and then expanded, which generates a doming effect in which the radius of curvature of the mask plate 21*a* decreases. Thereafter, the frame 22 is also heated and then expanded with time so that the radius of curvature of the mask plate 21*a* increases again.

The variation in the radius of curvature of the mask plate 21*a* causes a change in position of the electron beam passing holes 10 formed in the mask plate 21*a,* which results in an inaccurate landing of electron beams emitted from the electron gun onto a fluorescent body.

In the prior art, a scheme for compensating for the thermal expansion of the shadow mask assembly by varying the interval between the shadow mask assembly and the fluorescent film according to time is used, but does not provide a sufficiently satisfactory result.

SUMMARY OF THE INVENTION

In order to solve the above problem, it is an object of the present invention to provide a shadow mask assembly for CRT having an improved structure by which a doming effect due to thermal expansion of a shadow mask caused by collisions with electron beams can be reduced or prevented.

To accomplish the above object, there is provided a shadow mask assembly for a color cathode ray tube (CRT), comprising: a mask plate through which a plurality of electron beam passing holes are formed, a rim portion which extends from the edges of the mask plate and has a smaller radius of curvature than the radius of curvature of the plate, a skirt portion which extends perpendicularly downward from at least one of the longer and shorter edges of the rim portion, and a frame which supports the skirt portion by combining with the skirt portion.

Here, a folding seamed portion is formed between the mask plate and the rim portion.

It is preferable that a buffering groove for absorbing thermal expansion is formed on the folding seamed portion.

Also, preferably, the skirt portion extends from the longer edges of the rim portion.

BRIEF DESCRIPTION OF THE DRAWINGS

The above object and advantage of the present invention will become more apparent by describing in detail a preferred embodiment thereof with reference to the attached drawings in which.

DETAILED DESCRIPTION OF THE INVENTION

Figure 1:
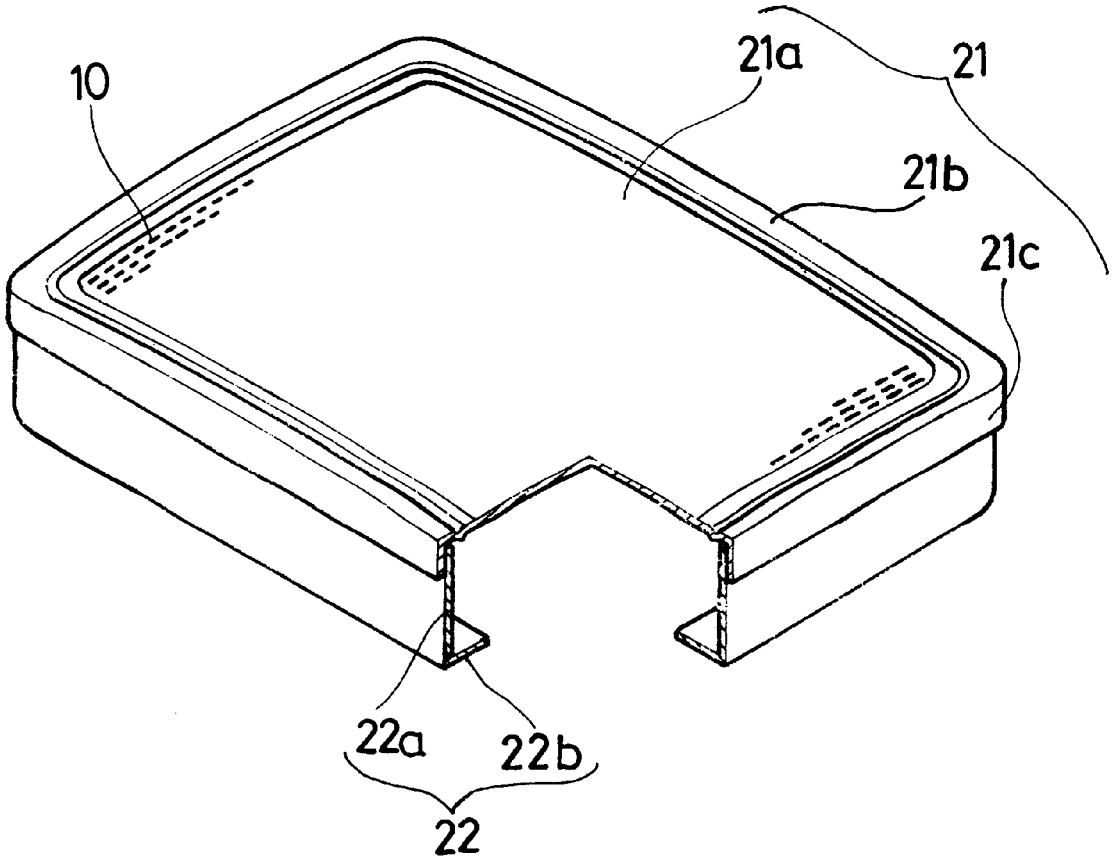
FIG. 1 (PRIOR ART)
FIG. 1 is a partially cut-out perspective view of a conventional shadow mask frame assembly.
Figure 2:
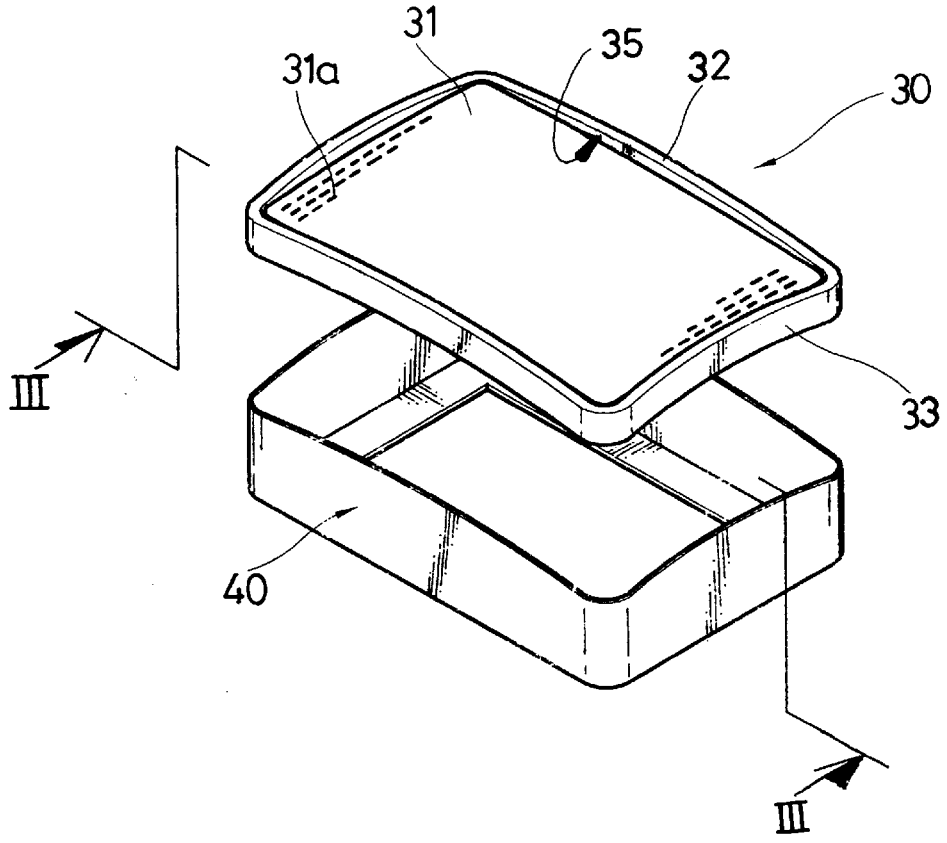
FIG. 2 is an exploded perspective view of a shadow mask assembly according to an embodiment of the present invention.
Figure 3:
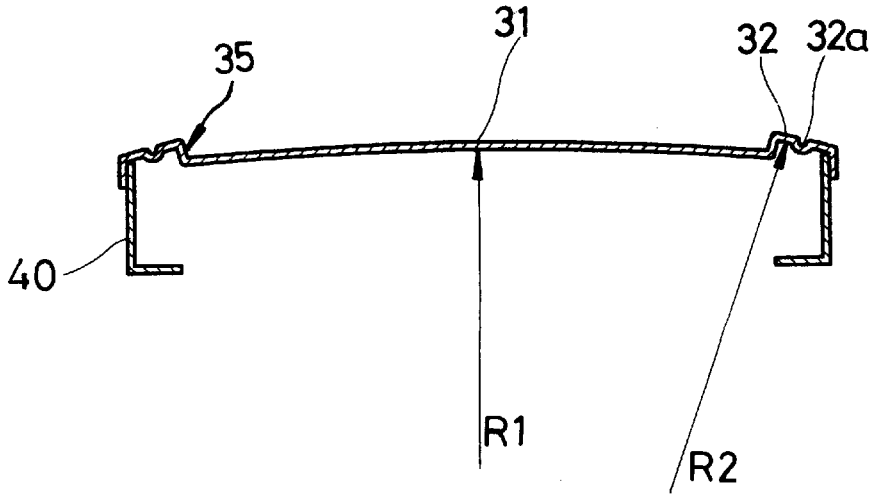
FIG. 3 is a sectional view taken along line III—III of FIG. 2.

Referring to FIGS. 2 and 3, a shadow mask assembly according to an embodiment of the present invention comprises a shadow mask 30 and a frame 40 combined with the shadow mask 30 to support the shadow mask 30.

The shadow mask 30 includes a mask plate 31 in which a plurality of electron beam passing holes 31*a* are formed, a rim portion 32 extending from the edge of the mask plate 31, and a skirt portion 33 extending perpendicularly downward from the rim portion 32. The frame 40 supports the shadow mask 30 by being combined with the skirt portion 33.

Figure 5:
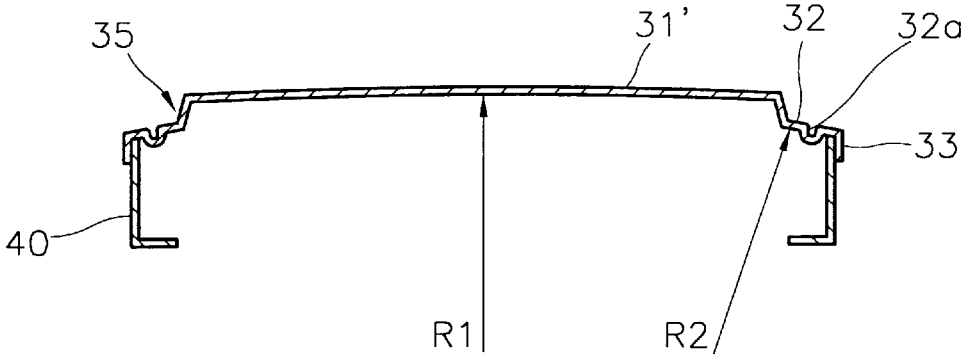
FIG. 5 is a sectional view showing a shadow mask assembly according to another embodiment of the present invention.

According to the present invention, the radius of curvature R1 of the mask plate 31 is greater than the radius of curvature R2 of the rim portion 32. Since the radius of curvature R1 of the mask plate 31 and the radius of curvature R2 of the rim portion 32 are different, a folding seamed portion 35 is formed on the boundary between the mask plate 31 and the rim portion 32. As shown in FIG. 3, the mask plate 31 can be formed lower than the rim portion 32 because of the folding seamed portion 35. Alternatively, as shown in FIG. 5, a mask plate 31' can be formed higher than the rim portion 32.

Figure 4:
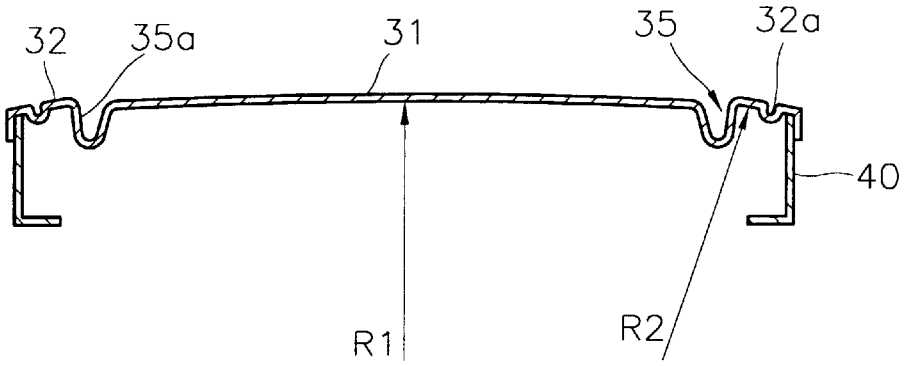
FIG. 4 is a sectional view showing buffering grooves formed at the folding seamed portion of FIG. 3.
Figure 6:
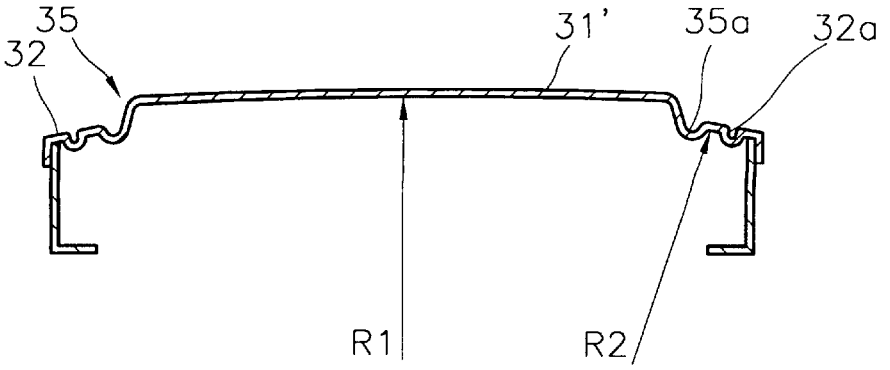
FIG. 6 is a sectional view showing buffering grooves formed at the folding seamed portion of FIG. 5.

A first buffering groove 32*a* can be formed on the rim portion 32 (see FIGS. 3 and 5) to buffer thermal expansion due to collision of electron beams. Also, it is preferable that a second buffering groove 35*a* be formed on the folding seamed portion 35 as shown in FIGS. 4 and 6 to alleviate the effects of thermal expansion and also to compensate for the difference between the radius of curvature of the mask plate 31 and the radius of curvature of the rim portion 32. Here, the same reference numerals in FIGS. 3 to 6 denote the same elements.

When the mask plate 31 is thermally expanded due to collisions with electron beams, the expansion can be absorbed by the rim portion 32 rather than the mask plate 31 since the radius of curvature R1 of the mask plate 31 is greater than the radius of curvature R2 of the rim portion 32. That is, the rim portion 32 having a relatively small radius of curvature is prone to deformation rather than the mask plate 31. Therefore, the doming effect in which the radius of curvature of the mask plate 31 gradually decreases during the thermal expansion, can be reduced.

Also, the folding seam 35 formed between the mask plate 31 and the rim portion 32, during the thermal expansion, is elastically deformed to absorb the expansion. Furthermore, such an elastic deformation is made easier by the first buffering groove 32*a* in the rim portion 32 and the second buffering groove 35*a* formed on the folded seam 35, so that absorption of the thermal expansion increases.

Figure 7:
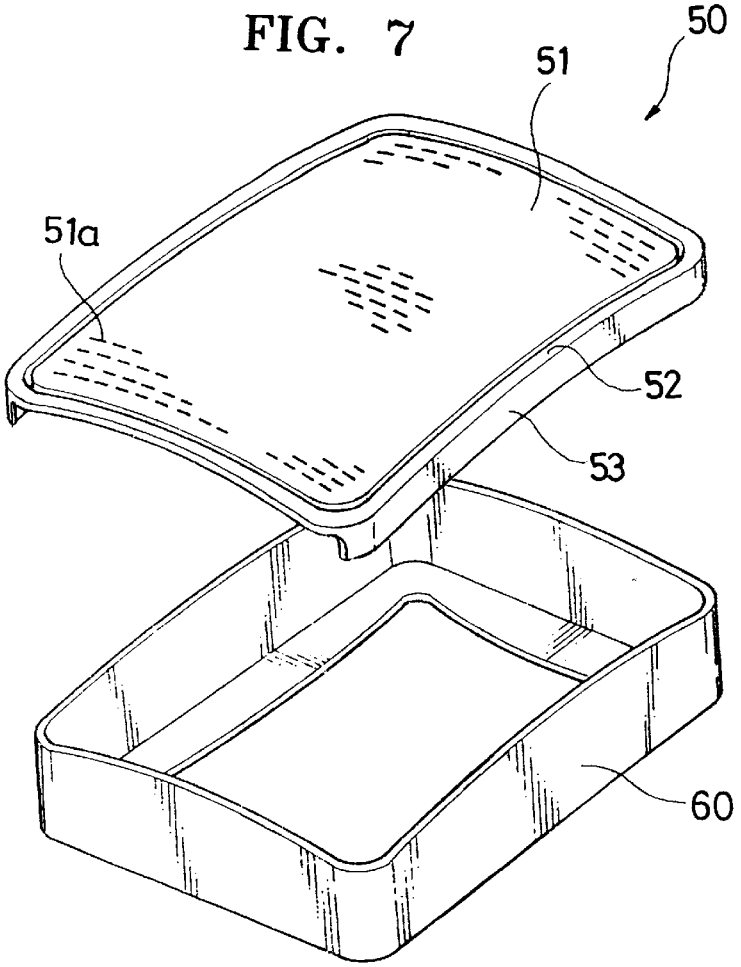
FIG. 7 is an exploded perspective view of a shadow mask assembly according to still another embodiment of the present invention.
Figure 8:
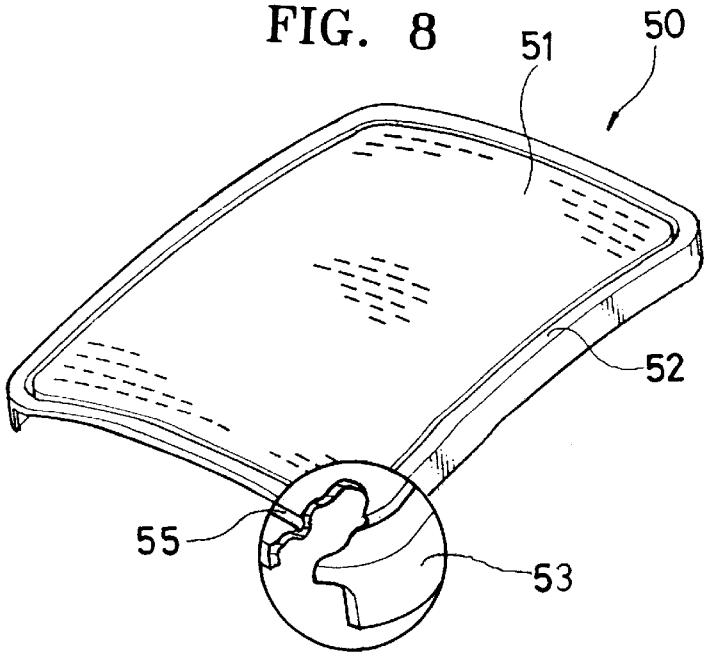
FIG. 8 is a partially cut-out perspective view of the shadow mask of FIG. 7.

A shadow mask assembly according to still another embodiment of the present invention will be described referring to FIGS. 7 and 8. As shown in FIGS. 7 and 8, the shadow mask 50 includes a mask plate 51 through which a plurality of electron beam passing holes 51*a* are formed and which has a predetermined curvature, a rim portion 52 which extends from the edge of the mask plate 51 and has a smaller radius of curvature than the radius of curvature of the mask plate 51, and a skirt portion 53 which extends perpendicularly downward from the longer sides of the rim portion 52. The skirt portion 53 supports the shadow mask 50 when combined with the frame 60.

Also, the aforementioned folded seam 35 (see FIGS. 3 to 6) is located between the mask plate 51 and the rim portion 52.

According to the present embodiment, a skirt portion is not formed on the shorter edges of the rim portion 52, and a skirt portion 53 is formed only on the longer edges thereof. Therefore, the formation of the skirt portion 53 is easier, and a spring back effect generated during formation can be reduced.

Furthermore, when the shadow mask 50 is heated and expanded due to collisions with electron beams, the shorter edges of the shadow mask 50 can compensate for the thermal expansion since they are free edges which are not contrained by the skirt portion and the frame 60. Thus, the doming effect of the shadow mask 50 can be reduced. In particular, only the longer edges of the shadow mask 50 are combined with the frame 60 and thus are under stress during thermal expansion. Accordingly, non-array of the electron beam passing holes due to the thermal expansion can be more easily compensated for by appropriately forming the folding seamed portion on the longer edges of the shadow mask. That is, the difficulty in controlling both the longer and smaller edges of the shadow mask can be avoided.

The present invention was described referring to the embodiments shown in the drawing, but it is only an example. It will be understood by those skilled in the art that various modifications and other equivalent embodiments may be effected. Therefore, the true scope of the present invention must be determined by the technical spirit of the appended claims.

What is claimed is:

1. A shadow mask assembly for a color cathode ray tube (CRT) comprising:

a mask plate having a plate curvature with a radius of curvature and including a plurality of electron beam passing holes;

a rim portion extending from a peripheral edge of said mask plate and having a rim curvature with a single radius of curvature smaller than the radius of curvature of said mask plate and having longer and shorter edges;

a skirt portion extending perpendicularly from at least one of the longer and shorter edges of said rim portion; and a frame combined with and supporting said skirt portion.

2. The shadow mask assembly for a color CRT as claimed in claim 1, including a folded seam located between said mask plate and said rim portion.

3. The shadow mask assembly for a color CRT as claimed in claim 2, including a buffering groove for absorbing thermal expansion located in said folding seamed portion.

4. The shadow mask assembly for a color CRT as claimed in claim 1, including a buffering groove for absorbing thermal expansion located in said rim portion.

5. The shadow mask assembly for a color CRT as claimed in claim 1, wherein said skirt portion extends from the longer edges of said rim portion but not from the shorter edges of said rim portion.

6. A shadow mask assembly for a color cathode ray tube (CRT) comprising:

a mask plate having a plate curvature with a radius of curvature and including a plurality of electron beam passing holes;

a rim having a rim curvature with a single radius of curvature smaller than the radius of curvature of said mask plate;

a folded seam joining said mask plate to said rim at a peripheral edge of said mask plate;

a skirt extending perpendicularly from edges of said rim; and a frame combined with and supporting said skirt.

7. The shadow mask assembly for a color CRT as claimed in claim 6, wherein said folded seam comprises a generally planar web extending between a first corner bend having, in cross-section, an obtuse interior angle and located at the peripheral edge of said mask plate and a second corner bend having, in cross-section, an obtuse interior angle and located at an edge of said rim, said web connecting said mask plate to said rim.

8. The shadow mask assembly for a color CRT as claimed in claim 7 including a buffering groove in said rim.

9. The shadow mask assembly for a color CRT as claimed in claim 7 including a first buffering groove in said rim and a second buffering groove adjacent said folded seam.

10. The shadow mask assembly for a color CRT as claimed in claim 6 wherein said folded seam is, in cross section, U-shaped.

11. The shadow mask assembly for a color CRT as claimed in claim 10 including a buffering groove in said rim.

12. A shadow mask assembly for a color cathode ray tube (CRT) comprising:

a mask plate having a plate curvature with a radius of curvature and including a plurality of electron beam passing holes;

a rim having a rim curvature with a radius of curvature smaller than the radius of curvature of said mask plate and having longer and shorter edges;

a folded seam joining said mask plate to said rim;

a skirt extending perpendicularly from the longer edges of said rim but not from the shorter edges of said rim; and a frame combined with and supporting said skirt only at the longer edges of said rim.

* * * * *